United States Patent [19]

Eibe

[11] 4,062,096

[45] Dec. 13, 1977

[54] VARIABLE CROWN ROLL

[75] Inventor: Werner W. Eibe, McCandless Township, Allegheny County, Pa.

[73] Assignee: Blau-Knox Foundry & Mill, Inc., Pittsburgh, Pa.

[21] Appl. No.: 756,416

[22] Filed: Jan. 3, 1977

[51] Int. Cl.[2] ..... B21B 31/08

[52] U.S. Cl. ..... 29/113 AD; 21/123

[58] Field of Search ..... 29/113 AD, 113 R, 110, 29/123, 116 AD

[56] References Cited

U.S. PATENT DOCUMENTS

| | | | |
|---|---|---|---|
| 1,630,470 | 5/1927 | Clifford | 29/113 R X |
| 2,970,339 | 2/1961 | Hausman | 29/113 R X |
| 3,457,617 | 7/1969 | Noe et al. | 29/113 R |
| 3,604,086 | 9/1971 | Bretschneider | 29/113 AD |

FOREIGN PATENT DOCUMENTS

| | | | |
|---|---|---|---|
| 46-43978 | 4/1971 | Japan | 29/113 AD |

*Primary Examiner*—Alfred R. Guest
*Attorney, Agent, or Firm*—Joan S. Keps; Richard D. Foggio; William H. Edgerton

[57] ABSTRACT

The roll comprises an arbor having a sleeve fitted over its central portion, together with means for introducing hydraulic fluid under pressure between arbor and sleeve to expand the latter and vary its crown. In one embodiment the arbor is provided with a fixed shoulder at one end having an undercut bevel in its inner face and a movable collar on the other end, likewise provided with a shoulder having an undercut bevel on its inner face, and the sleeve has bevelled ends. The hydraulic means are adapted to urge the collar toward the first shoulder, wedging the ends of the sleeve against the arbor. In another embodiment, the arbor is tapered slightly at one end and the inner surface of the sleeve end is also tapered so that movement of the collar wedges the sleeve over the taper of the arbor. A filler is also provided to fill most of the space between arbor and sleeve and so reduce the amount of hydraulic fluid required to fill the roll. A third embodiment has a liner in the space between sleeve and arbor, attached to the sleeve at each end, and means for introducing the hydraulic fluid between sleeve and liner, so as to strengthen the grip of the sleeve on the mandrel as the roll crown is increased.

14 Claims, 6 Drawing Figures

VARIABLE CROWN ROLL

Figure 1:
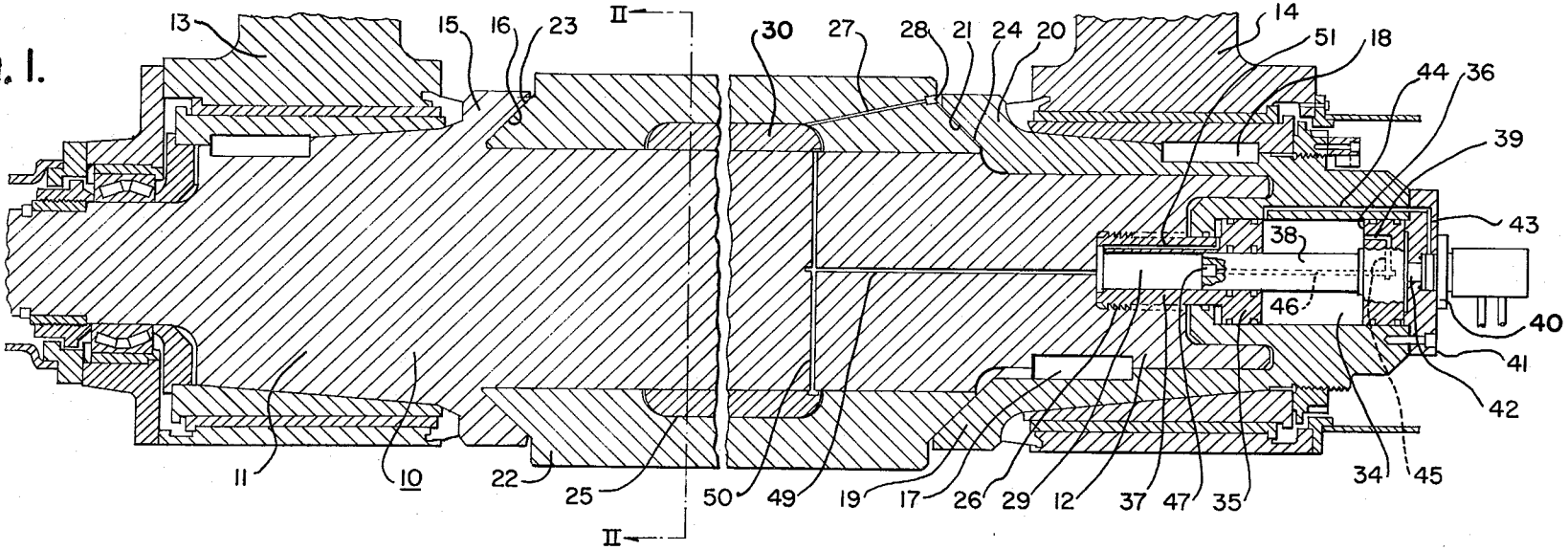

This invention relates to variable crown rolls for rolling mill stands. It is more particularly concerned with such rolls in which the variation of crown is accomplished within the roll.

I describe my invention hereinafter as applied to back-up rolls for four-high rolling mills, but it may be embodied in any roll which requires a crown.

Backup rolls are commonly used in four-high mill stands for metal strip and the like to apply rolling pressure to smaller diameter work rolls. The latter tend to bow away from the work in the center when the large forces required for rolling are applied to the roll necks. To counteract this tendency, the roll stands are provided with larger diameter back-up rolls and the rolling forces are applied to the necks of those more rigid rolls which, in turn, transmit rolling pressure to the bodies of the work rolls. Even in four-high mill stands, however, some springing or bowing of the work rolls occurs, and it has been compensated for conventionally by grinding a crown on the backup rolls. Crowned rolls are of somewhat greater diameter in the middle than at the ends. A fixed crown, however, results in flat strip only for a single strip width and roll force.

While it is possible and quite generally practiced to compensate for work roll deflection by bending the work roll in the opposite direction, that practice has the disadvantage that every change in crown also alters the gauge of the metal being rolled. This necessarily happens because the roll-bending force has a vertical component that opposes the screwdown force.

Attempts have been made to provide adjustable crown rolls which require no roll bending apparatus. An example is the roll of Noe, et al., U.S. Pat. No. 3,457,617 of July 19, 1969. Their roll, which is a work roll, comprises a mandrel with a sleeve thereon together with means for introducing hydraulic fluid under pressure between mandrel and sleeve to bow the latter, and thus provide an adjustable or variable crown on the roll. Such rolls, however, are unsatisfactory. Even though the sleeve is shrunk on the mandrel to begin with, the rolling forces tend to reduce the shrinkage stresses and the hydraulic pressure that produces the crown tends to cause the sleeve to separate from the mandrel. A loosened sleeve may tear off keys or pins intended to position it on the mandrel, or may shift longitudinally of the mandrel.

It is an object of my invention, therefore, to provide a variable crown roll comprising a mandrel and sleeve in which the sleeve will not separate from the mandrel. It is another object to provide such a roll in which the crowning force does not reduce the gripping force of the sleeve on the arbor. It is another object to provide such a roll which requires a minimum amount of hydraulic fluid within the roll. It is still another object to provide such a roll having crowning apparatus which is also usable to mount the sleeve on the roll or remove it therefrom. It is yet another object to provide such a roll in which the grip of the sleeve on the collar increases with an increase in roll crown. Other objects of my invention will appear in the course of the description thereof which follows.

My invention comprises, briefly a mandrel and sleeve type roll having shoulders on the mandrel bearing on the ends of the sleeve and means for increasing the force with which those shoulders hold the sleeve against the mandrel simultaneously with increase in the force providing crown in the sleeve.

Figure 2:
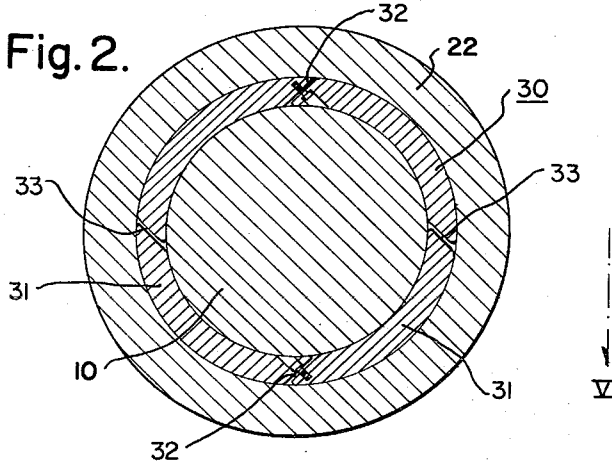
Figure 5:
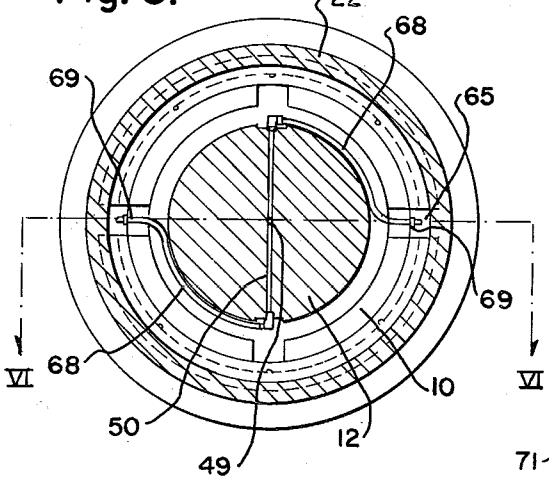
Figure 6:
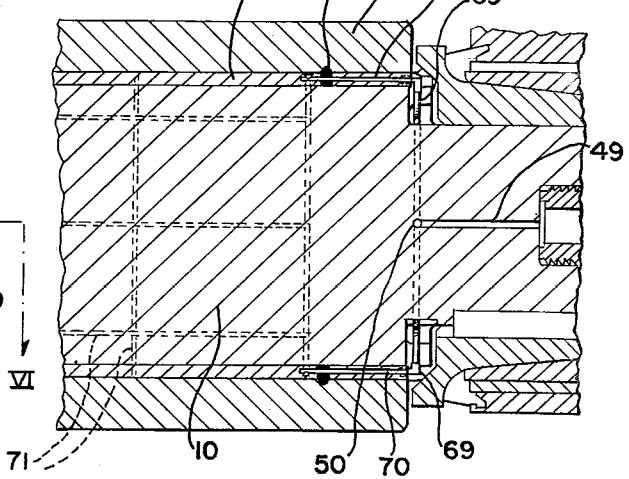
Figure 3:
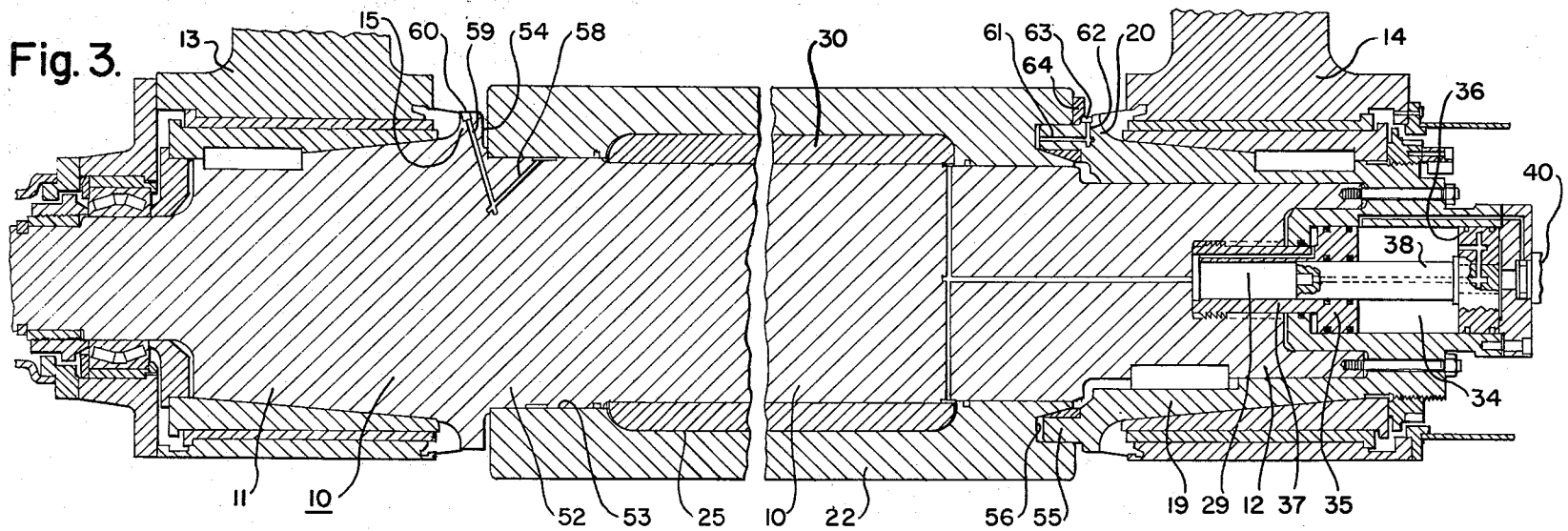
Figure 4:
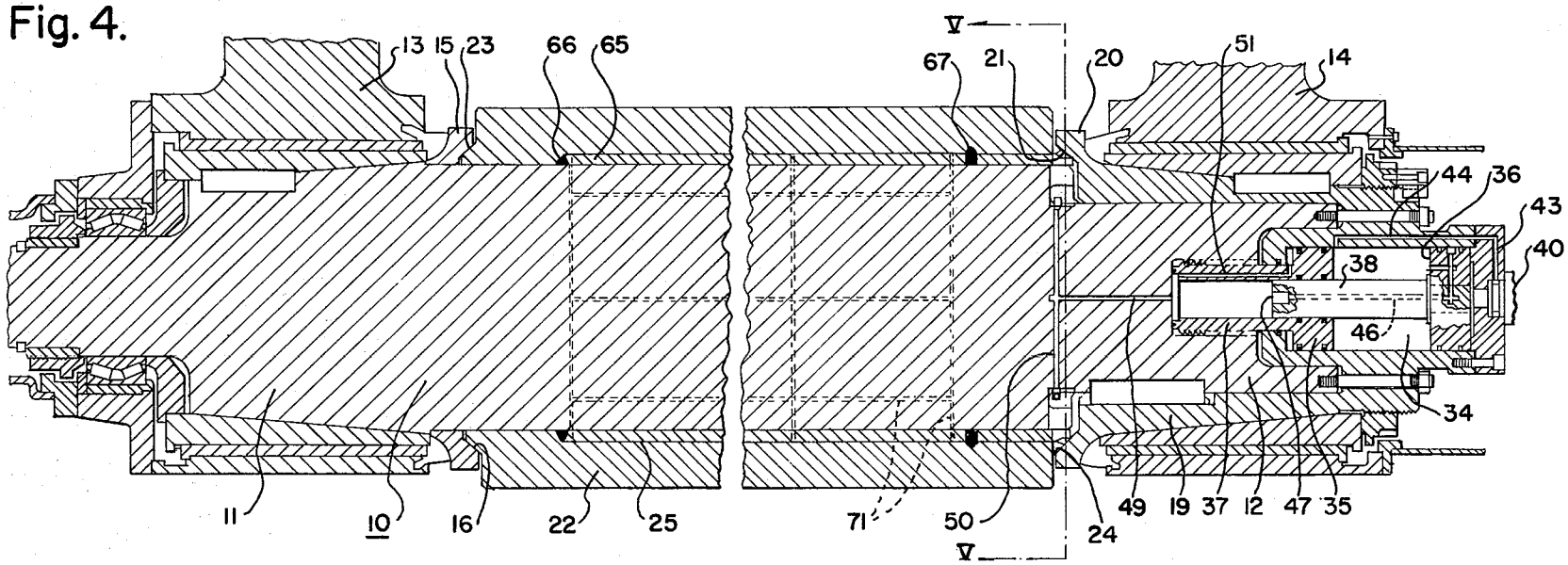

Embodiments of my invention presently preferred by me are illustrated in the attached figures to which reference is now made:

FIG. 1 is a vertical longitudinal section through a first embodiment of a variable crown roll of my invention, FIG. 2 is a cross section through the roll of FIG. 1 taken on the plane II—II of FIG. 1, FIG. 3 is a vertical longitudinal section through a second embodiment of a variable crown roll of my invention, FIG. 4 is a vertical longitudinal section through a third embodiment of my invention, FIG. 5 is a cross section through the roll of FIG. 4 taken on the plane V—V of that figure, and FIG. 6 is a horizontal longitudinal section through a portion of the roll of FIG. 5 taken on the plane VI—VI of FIG. 5.

As may be seen in FIG. 1, the arbor 10 of my roll is provided with roll necks 11 and 12 at either end. Roll neck 11 is suitable for mounting in a conventional chock 13. Adjacent roll neck 11, arbor 10 is formed with a shoulder 15 having an inner face 16 which is undercut to a bevel. Surrounding roll neck 12 is a collar 19 the outer surface of which has the same contour and dimensions as the outer surface of roll neck 11 so that it is suitable for mounting in a conventional chock 14. Collar 19 is dimensioned to slide axially on roll neck 12, but is keyed thereto by keys 17 and 18 to prevent rotation between collar and roll neck. Collar 19 on its inner end adjacent the inner end of roll neck 12 is formed into a shoulder 20 similar to shoulder 15 and likewise having an inner face 21 which is undercut to a bevel.

Centrally mounted to arbor 10 is sleeve 22, between shoulders 15 and 20. Sleeve 22 has ends with chamfers or bevels 23 and 24 which fit into undercut faces 16 and 20 respectively. The inside surface of sleeve 22 is hollowed so as to form an annular cavity 25 which extends over the central portion of sleeve 22. Cavity 25 is vented to an end of sleeve 22 through passage 27 which is provided with a closure 28.

Within cavity 25 is positioned a cylindrical filler 30 dimensioned to leave only a small unfilled gap between sleeve 22 and arbor 10. Filler 30 is conveniently constructed of four identical longitudinal sections 31 as is shown in FIG. 2. These are bolted together along alternate joints 32, leaving clearance between the other pair of joints 33.

The hydraulic means for operating my apparatus are contained in cylinder 34 mounted at the outer end of collar 19. Within cylinder 34 are inner or clamping piston 35 and outer or crowning piston 36. Inner piston 35 has a hollow piston rod 37 which extends through the inner end of cylinder 34 and is threaded into a tapped bore 26 in neck 12 of arbor 10. Outer piston 36 has a piston rod 38 which passes through inner piston 35 into the bore 29 of hollow piston rod 37. Hydraulic fluid is supplied to my roll through a rotary valve 40 on end cap 41 of cylinder 34. In one valve position the fluid passes through port 42 into cylinder 34 between outer piston 36 and the inner face of end cap 41. In the other valve position hydraulic fluid passes through a cross bore 43 in end cap 41 and longitudinal bore 44 in roll neck 20 into cylinder 34 at a point on the other side of piston 36 past which inner piston 35 can move. A connection between the inner end of cylinder 34 and the bore 29 of piston rod 37 is formed through a bore 39 in the inner face of outer piston 36, cross bore 45, axial bore 46 in piston 38 and check valve 47 opening out of the outer end of that piston.

Opening from the inner end of bore 29 through roll neck 12 is a passage 49 which, through cross passage 50, connects with the cavity 25 in sleeve 22. A longitudinal bore 51 is provided through the wall of piston rod 37 from bore 29 of piston rod 37 at its inner end to the outer surface of piston rod 37 immediately adjacent the inner face of piston 35.

The operation of my apparatus above described also will be described with reference to FIGS. 1 and 2. The roll is necessarily assembled dry. Filler 30 is placed in cavity 25 by inserting the sections 31 separately and fastening them together from the inside along one pair of diametrically opposed junctions. Sleeve 22 containing filler 30 is then mounted on arbor 10 by sliding it over roll neck 12 until beveled end 23 mates with undercut face 16 of shoulder 15. Collar 19 is then slid on over roll neck 12 until undercut face 21 of shoulder 20 fits against bevel 24 of sleeve 22. This sliding movement of collar 19 is effected by screwing piston rod 37 into its threaded seat 26 within roll neck 12, which draws inner piston 35 towards the inner end of cylinder 34. Piston 38 is then inserted into the bore 29 of piston rod 37, and when piston 36 is within cylinder 34, end cap 41 is fastened to the outer end of collar 19.

Hydraulic fluid is introduced through rotary valve 40 and bores 43 and 44 into cylinder 34 between pistons 35 and 36. The fluid also passes through bore 39, bores 45 and 46 and check valve 47 into bore 29 of piston rod 37 and through passages 49 and 50 in arbor 10 into cavity 25. After the roll is filled with fluid, rotary valve 40 is switched so that the fluid is directed through port 42 against the outside face of piston 36.

It will be evident that the pressure in bore 29 will be a multiple of that exerted against piston 36 in the ratio of the area of piston 36 to the area of piston rod 38. That higher pressure will be transmitted through the fluid in passages 49 and 50 to cavity 25, thus expanding sleeve 22 centrally and increasing the crown of the roll. That same high pressure will also be transmitted through the fluid in bore 51 to the space between piston 35 and the inside end of cylinder 34, urging them apart. Collar 19 will thereby be urged against sleeve 22. The undercut faces 16 and 21 of shoulder 15 and 20 respectively will be urged against the beveled ends 23 and 24 of sleeve 22, forcing them against arbor 10 and counteracting separating forces at those ends arising from the expansion of sleeve 22.

A second embodiment of my invention is shown in FIG. 3. It is the same in most respects as that of FIGS. 1 and 2 described above and like parts carry the same reference characters as in FIGS. 1 and 2. The portion 52 of arbor 10 between shoulder 15 and the end of the cavity 25 tapers slightly outwardly toward shoulder 15. The inner surface 53 of that end of sleeve 22 is tapered in the same way. Shoulder 15 has a square end face 54. Shoulder 20 is formed with an annular tapered tongue 55 extending toward shoulder 15 and the corresponding end of sleeve 22 is formed with an annular tapered groove 56 therein which mates with tongue 55. An inclined bore 58 from the surface of tapered portion 52 of arbor 10 together with a meeting oppositely inclined bore 59 emerging from shoulder 15 is mounted at shoulder 15 with a closure 60, and axial bore 61 from the outer end of tapered tongue 55 meets a radial bore 62 in shoulder 20 and is provided at shoulder 20 with a closure 63.

The roll of FIG. 3 is assembled in the same way as that of the embodiment illustrated in FIGS. 1 and 2 and has its crown varied in the way previously described in connection with my first embodiment. The inside tapered end 53 of sleeve 22 seals against the tapered portion 52 of the arbor 10 as collar 19 is moved inwardly over roll neck 12. An auxiliary U-shaped filler ring 64 is placed between the collar 19 and the face of sleeve 22. This prevents the tongue 55 from seating into groove 56 while sleeve 22 seats on taper 52. The filler ring 64 is then removed, and tapered tongue 55 of shoulder 20 seals in groove 56 in the end of sleeve 22. Any tendency of tapered surfaces 52 and 53 to separate because of expansion of sleeve 22 merely results in enough additional axial movement of sleeve 22 to close the seal. Any axial movement of sleeve 22 away from collar 19 is counteracted by movement of collar 19 in the same direction in the manner previously described in connection with my first embodiment, and the seal between tapered tongue 55 and groove 56 is maintained. Any tendency of sleeve 22 to separate from arbor 10 at its end adjoining collar 19 is counteracted by the wedging action of tongue 55 in groove 56. When the pressure in cavity 25 is released, the seal between tapered portions 52 and 53 is broken by injecting hydraulic fluid under pressure into bore 59. The seal between tongue 55 and groove 56 is broken by injecting hydraulic fluid under pressure into bore 62.

The function of liner 30 in both above described embodiments of my invention is to fill most of the cavity 25 between arbor 10 and sleeve 22 so as to minimize the quantity of hydraulic fluid required to fill the roll. In order to obtain the desired range of crown with the fluid pressure available, the ratio between the sleeve thickness at its ends and at its center may be such that the volume of the cavity is substantial.

A third embodiment of my invention is shown in FIGS. 4, 5 and 6. It is similar in most respects to the apparatus of FIGS. 1 and 2 described herein, and like parts of the apparatus are identified by the same reference characters. In this embodiment, annular cavity 25 in sleeve 22 is occupied by a cylindrical liner 65 which is joined by an annular weld 66 to the end of cavity 25 adjacent roll neck 11 and is joined by annular weld 67 to cavity 25 near its end adjacent roll neck 12. In order that liner 65 may be inserted in cavity 25, that cavity is elongated to the end of sleeve 22 which adjoins roll neck 12. Liner 65 substantially fills cavity 25 except for a small gap or clearance space between the outside of liner 65 and the surface of cavity 25, which clearance space, however, is closed at each end by welds 66 and 67 above mentioned.

Roll neck 12 is smaller in diameter than the body of arbor 10 and joins that body at an end of sleeve 22. Cross bore 50 is located in roll neck 12 at that junction, as is shown in FIG. 4. Each end of cross bore 50 is connected to a length of tubing 68 which is curved around roll neck 12 through an angle of 90° so that the other ends 69 of tubing lengths 68 lie on a diameter of the roll normal to the axis of cross bore 50, as is shown in FIG. 5. Those ends 69 are connected by elbows to longitudinal bores 70 in the end of liner 65, which bores extend through the weld 66 and open into the clearance space between liner 65 and sleeve 22—see FIG. 6. The outer surface of liner 65 is provided with shallow circumferential and longitudinal grooves 71 which connect with bores 70 and facilitate distribution of hydraulic fluid in the clearance space between sleeve 22 and liner 65.

When hydraulic fluid is forced through bores 49 and 50, it passes through tubing sections 68 and liner bores 70 into the clearance space between sleeve 22 and liner 65. That fluid tends to separate sleeve 22 and liner 65, causing sleeve 22 to form a crown on the roll and the liner 65 to grip arbor 10. The gripping force of sleeve 65 on arbor 10 is seen to increase as the crown of the roll increases by the distortion of sleeve 22. The relative thicknesses of sleeve 22 and liner 65 are chosen to obtain the desired ratio between crowning force and gripping force.

In the foregoing specification I have described presently preferred embodiments of my invention; however, it will be understood that my invention can be otherwise embodied within the scope of the following claims.

I claim:

1. A variable crown roll for a rolling mill stand comprising an arbor having shoulders at each end, at least one shoulder being carried by a collar movable axially on the arbor, a sleeve surrounding the arbor between those shoulders so as to provide a working surface for the roll and being hollowed between its ends to form an elongated annular cavity between sleeve and arbor, means for supplying hydraulic fluid under pressure through the arbor to that cavity so as to expand the sleeve centrally and vary its crown, and hydraulic means connecting the arbor and the collar supplied with hydraulic fluid under pressure so as to urge the shoulders against the sleeve and clamp the ends of the sleeve against the arbor when hydraulic fluid is supplied to the cavity.

2. The roll of claim 1 in which the arbor is tapered inwardly adjacent one shoulder and the corresponding end of the sleeve is tapered outwardly so that operation of the hydraulic means firmly affixes the sleeve to the arbor through wedging action between the tapered portions thereof.

3. The roll of claim 1 in which the shoulders are undercut and the ends of sleeve are beveled so as to wedge between the shoulders.

4. The roll of claim 1 in which the hydraulic means comprise a hydraulic cylinder fixed within the collar having a clamping piston with a piston rod extending through the inner end of the cylinder and connected to the arbor and means for introducing hydraulic fluid under pressure between the inner end of the cylinder and the clamping piston.

5. The roll of claim 4 in which the clamping piston rod is hollow so as to form a high pressure cylinder and including a crowning piston within the hydraulic cylinder having a piston rod slidably fitting within the high pressure cylinder so as to form a hydraulic intensifier.

6. The roll of claim 5 in which the means for introducing hydraulic fluid under pressure between the inner end of the cylinder and the clamping piston are supplied from the high pressure cylinder.

7. The roll of claim 5 including a conduit extending lengthwise of the crowning piston connected at its outer end to the means for introducing hydraulic fluid under pressure and at its inner end to a check valve in the end of the piston opening into the high pressure cylinder.

8. The roll of claim 5 in which the means for supplying hydraulic fluid under pressure through the arbor to the cavity include the high pressure cylinder.

9. The roll of claim 5 including rotary means for introducing hydraulic fluid under pressure through the roll end into the hydraulic cylinder between the outer end thereof and the crowning piston and into the volume between pistons in the hydraulic cylinder.

10. The roll of claim 7 including in the crowning piston an opening from the inside face thereof into the conduit extending lengthwise of the crowning piston rod.

11. A variable crown roll for rolling mill stands comprising a cylindrical arbor, a sleeve surrounding the arbor intermediate the ends thereof so as to provide a working surface for the roll and being hollowed between its end to form an elongated annular cavity between sleeve and arbor, means for supplying hydraulic fluid under pressure through the arbor to that cavity, so as to expand the sleeve centrally and vary its crown, and a cylindrical filler positioned within the cavity so as to reduce substantially the volume thereof filled with hydraulic fluid.

12. The roll of claim 11 in which the filler comprises a plurality of longitudinal sections.

13. A variable crown roll for rolling mill stands comprising a cylindrical arbor, a sleeve surrounding the arbor intermediate the ends thereof so as to provide a working surface for the roll, and being hollowed between its ends to form an elongated annular cavity between sleeve and arbor, a cylindrical liner positioned in that cavity and attached to the sleeve at each end so as to leave a clearance space between liner and sleeve, and means for supplying hydraulic fluid under pressure through arbor to the clearance space between sleeve and liner so as to expand the sleeve and liner away from each other, whereby as the crown of the roll is increased, the grip of the liner on the mandrel is strengthened.

14. The roll of claim 13 in which the liner is provided with grooves on its surface adjacent the sleeve positioned to facilitate distribution of the hydraulic fluid in the clearance space between sleeve and liner.

* * * * *

UNITED STATES PATENT OFFICE

CERTIFICATE OF CORRECTION

Patent No. 4,062,096 Dated December 13, 1977

Inventor(s) WERNER W. EIBE

It is certified that error appears in the above-identified patent and that said Letters Patent are hereby corrected as shown below:

"Blau-Knox Foundry & Mill, Inc." should read "BLAW-KNOX FOUNDRY & MILL MACHINERY, INC." as Assignee.

Column 1, line 37, "July 19, 1969" should read --July 29, 1969--.

Column 2, line 35, "to" should read --on--.

Column 3, line 66, "mounted" should read --provided--.

Column 6, Claim 13, line 46, "before "arbor" should read --the--.

Signed and Sealed this

Fourth Day of April 1978

[SEAL]

Attest:

RUTH C. MASON
Attesting Officer

LUTRELLE F. PARKER
Acting Commissioner of Patents and Trademarks

UNITED STATES PATENT AND TRADEMARK OFFICE

CERTIFICATE OF CORRECTION

PATENT NO. : 4,062,096

DATED : December 13, 1977

INVENTOR(S) : Werner W. Eibe

It is certified that error appears in the above—identified patent and that said Letters Patent is hereby corrected as shown below:

On the title page, the Attorney, Agent, or Firm should be -- Buell, Blenko and Ziesenheim --.

Signed and Sealed this

*Twenty-third* Day of *June 1981*

[SEAL]

*Attest:*

RENE D. TEGTMEYER

*Attesting Officer*

*Acting Commissioner of Patents and Trademarks*